US005174166A

United States Patent [19]

Tryon et al.

[11] Patent Number: 5,174,166

[45] Date of Patent: Dec. 29, 1992

[54] UNIVERSAL STEP STARTER FOR SMALL ENGINES

[76] Inventors: Lewis H. Tryon, 531 East Hwy. 434, Winter Springs, Fla. 32708; David S. Tryon, 814 Ashby Way, Osteen, Fla. 32764

[21] Appl. No.: 694,505

[22] Filed: May 2, 1991

[51] Int. Cl.[5] ..... F02N 3/02

[52] U.S. Cl. ..... 74/6; 187/11; 74/512; 74/140

[58] Field of Search ..... 74/6, 140, 512, 128, 74/139; 56/10.5; 123/185 A, 185 B, 185 BB, 185 D, 179 SE; 104/91, 94, 173.1, 172.3; 187/9 R, 11

[56] References Cited

U.S. PATENT DOCUMENTS

| | | | |
|---|---|---|---|
| 1,458,195 | 6/1923 | Pavey | 187/11 |
| 2,912,966 | 11/1959 | Mitchell | 123/185 A |
| 2,941,685 | 6/1960 | McCune | 187/11 |
| 2,975,777 | 3/1961 | Gustafsson | 123/185 |
| 2,996,134 | 8/1961 | Muerle et al. | 123/185 AA |
| 3,018,768 | 1/1962 | Thompson | 74/140 |
| 3,040,726 | 6/1962 | Mayer | 56/10.5 |
| 3,310,003 | 3/1967 | Bryan | 104/94 |
| 3,381,677 | 5/1968 | Hunter | 123/185 BB |
| 3,626,937 | 12/1971 | Gjovik | 74/140 |
| 3,718,129 | 2/1973 | McKee | 123/185 B |
| 4,109,538 | 8/1978 | Glenday et al. | 123/185 A |
| 4,257,367 | 3/1981 | Fujikawa et al. | 74/6 |
| 4,614,158 | 9/1986 | Helde | 104/91 |
| 4,782,761 | 11/1988 | Asberg | 104/173.1 |

*Primary Examiner*—David A. Scherbel
*Assistant Examiner*—Winnie Yip
*Attorney, Agent, or Firm*—Macdonald J. Wiggins

[57] ABSTRACT

A step starter for attachment to devices having small internal combustion engines of up to 15 horsepower or more having recoil-type starters includes a vertical track formed from channel stock. A trolley having a foot pedal extending therefrom is disposed in the track. A distal end of the engine starter pull cord is attached to the trolley. An operator steps on the pedal and depresses the pedal downward thereby operating the recoil starter. The track includes a mounting bracket formed to permit attachment of the step starter to a desired device.

7 Claims, 1 Drawing Sheet

UNIVERSAL STEP STARTER FOR SMALL ENGINES

BACKGROUND OF THE INVENTION

1. Field of the Invention

The present invention relates to small horsepower lawnmower, and more particularly to a step starter attachable to most such engines having a recoil-type hand starter.

2. Description of the Prior Art

Small internal combustion engines are used in a wide variety of equipment such as lawnmowers, edgers, tillers, auxiliary power units, compressors, and specialized power equipment. Commonly, a pull-cord type starting device having a cord connected to a recoil unit is provided by the manufacturer. A handle attached to the outer end of the cord is pulled by the user to start the engine. Such starters work satisfactorily for engines of small horsepower, and in good working condition. However, as an engine deteriorates, starting becomes difficult, and places a heavy strain on the user, particularly persons of little strength or stamina. For engines of 10 to 15 horsepower, and greater, starting with a hand-operated recoil starter is difficult even for persons of high physical strength. In addition, mowers having engines rated at 11 horsepower and greater with cutting decks of over 30 inches need not comply with federal safety standards for walk-behind power lawnmowers. Such engines require a strong pull on the hand held rope starter. The operator must stand alongside the mower with his feet adjacent to the cutting deck. Further, the operators's hands are not free to operate the drive or engine controls. The risk of accidental injury is therefore significant. The present invention may be retrofitted to most engines of the type described above, and solves the safety and difficult starting problems of such engines by providing a foot-operated starter.

Some attempts have been made in the prior art to provide a foot-operated starter for power lawnmowers and the like. However, the prior art does not disclose a universal step starter that can be attached to almost any such engine. U.S. Pat. No. 4,109,538 shows a clamp device for attaching to the handle of a lawnmower in which one end of the device rests on the ground. The recoil starter pull cord of the engine has a stirrup replacing the usual T-handle, and which accepts the user's foot. U.S. Pat. No. 3,381,677 teaches a customized, pivoted bracket for attaching to a lawnmower. That invention includes a special spring, wound around the crankshaft, in which the bracket has a pedal for forcing the bracket downward with the foot. Several external devices, including foot pedals, for starting an engine e shown in U.S. Pat. No. 4,257,367. U.S. Pat. No. 2,975,777 discloses a foot starter using a rack and pinion; and U.S. Pat. No. 3,040,726 teaches a foot starter having a helical drive element for rotating the crankshaft of an engine. The prior art devices appear relatively complex, expensive, or not usable with a wide variety of engines.

There is a need for a simple. low-cost step starter that can be easily installed on almost any small engine having a recoil type hand operated starter, requiring an operative connection only to the pull cord, and that permits safe starting procedures.

SUMMARY OF THE INVENTION

The step starter of the invention provides a vertical track, having a small trolley movable along the length of the track. A foot pedal projects horizontally from the trolley. One or more brackets are attached to the track for bolting to the frame of an engine or apparatus. When installed on a lawnmower, it is preferable to mount the track at the rear of the mower deck, thereby providing the operator to free use of his hands to control the engine and drive system for maximum safety.

A pulley at the upper end of the track accepts the pull cord from the engine recoil starter. The end of the pull cord is attached to the trolley so as to place the trolley at the upper end of the track when the cord is retracted. To start the engine, the user steps downward on the pedal with the foot to rotate the engine crankshaft. When the foot is removed, the existing recoil device on the engine retracts the pull cord, returning the trolley to the top of the track. When the invention is installed on a lawnmower, the operator may stand with his feet clear of the mower deck, and maintain his hands on the mower controls.

To install the kick starter of the invention, the track is positioned to obtain a direct line from the pulley to the point at which the pull cord exits from its reel. A bracket is fabricated and attached to the track. The bracket is bolted or welded to the frame of the device using the engine. The T-handle is removed from the pull cord, the end passed over the pulley, and attached to the trolley. The unit is then ready for operation.

As will now be recognized, the invention permits a person to utilize the large muscles in the leg, stepping with a straight downward stroke. Thus, the invention conserves energy, and permits persons of all ages, and strength to easily and quickly start small engines, and without danger of injury.

It is therefore a principal object of the invention to provide a universal step starter that can be adapted to operate with most internal combustion engines having recoil type starters.

It is another object of the invention to provide a kick starter having a vertical track, a trolley operating in the track, and a foot pedal attached to the trolley, in which the track is attachable to most small engine-operated devices.

It is still another object of the invention to provide a step starter that can be installed on an existing engine operated device having a recoil starter with no modification of the device It is yet another object of the invention to provide a step starter for permitting easy starting of small engines up to ten or more horsepower, with safety.

It is another object of the invention to provide a simple. low cost step starter for adding to existing lawnmowers, and other apparatus having small horsepower internal combustion engines.

These and other objects and advantages will become apparent from the following detailed description when read in conjunction with the drawings.

DETAILED DESCRIPTION OF THE PREFERRED EMBODIMENT

Figure 1:
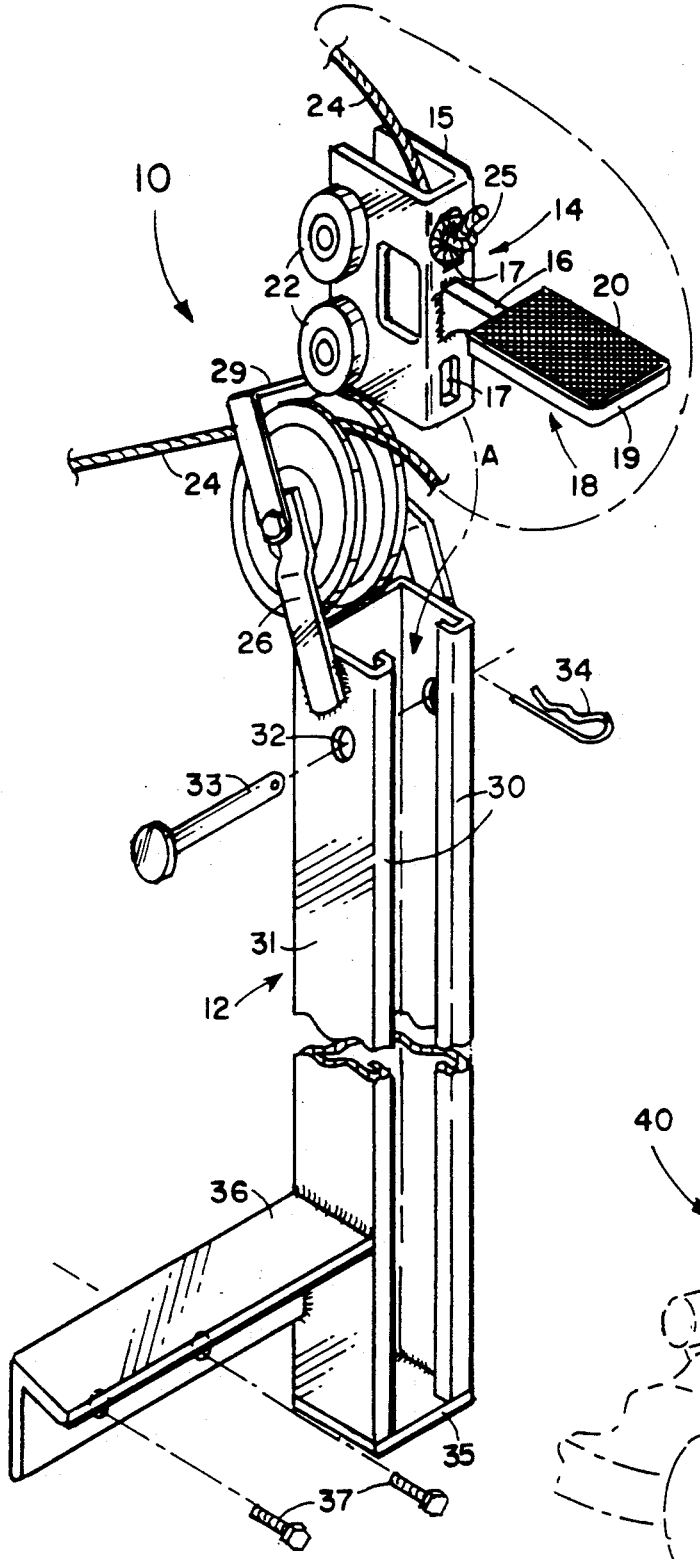
FIG. 1 is a perspective, exploded view of the universal kick starter of the invention.

The universal step starter 10 of the invention is shown in exploded view in FIG. 1. A track 12 is oriented vertically in use, and is formed from a section of channel stock, preferably steel, having sides 31 and rails 30. A bottom plate 35 is welded to the lower end of track 12. Track 12 is preferably formed from a section of Unistrut®, available from Unistrut Corporation, of Pompano Beach, Fla.

A trolley unit 14 is shown that is formed to ride within track 12. Trolley unit 14 includes a body 15, a set of four wheels 22. the front face of trolley unit 14 includes openings 17, with upper opening having cord 24 passing therethrough, with knot 25 formed in the end thereof. A bracket 16 extends from body 15 and supports pedal 19. A non-slip surface 20 is provided on pedal 19 which may be a rubber or abrasive pad, or may be a scored surface of pedal 19. A trolley body 15 and wheels 22 is available from Unistrut Corporation for the specific track stock Unistrut® used for track 12. As will be understood, various sizes of track 12 and trolley unit 14 may be selected in accordance with the size of engine with which starter 10 is to be used.

Figure 2:
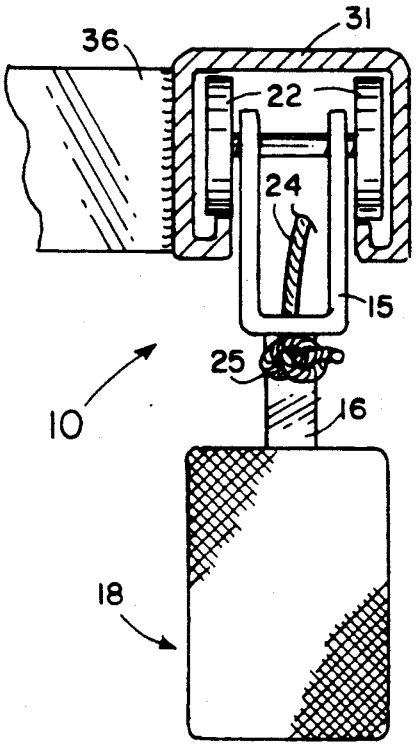
FIG. 2 is a top view of the starter of FIG. 1 with the rack thereof shown in cross section.

At the upper end of track 12, a pair of brackets 26 is welded, or otherwise attached, that supports pulley 28. Cord 24 is a pull cord from an engine having a recoil type starting mechanism. Cord 24 passes over pulley 28 and is threaded, as indicated by arrow B, through trolley body 15 though upper opening 17, and secured by knot 25. A guard 29 is mounted over pulley 28 to maintain cord 24 in place, After attaching cord 25 to trolley unit 14, trolley unit 14 is inserted into track 12 as indicated by arrow A. As best seen in FIG. 2, wheels 22 ride on track rails 30 and inner surface 38 of the back portion of track 12. A pin 33 is inserted through holes 32 and secured with clip 34 to captivate trolley unit 14.

Starter 10 is shown with an exemplary bracket 36 welded to track side 36 adjacent the lower end thereof. Bracket 36 may be attached to the device having the engine to be started; for example, by bolts 37. It is to be understood that other types and orientation of attachment brackets may be used to fit the specific device with which the invention is to be used. The point of attachment of bracket 36 along track 12 selected to place pulley 28 aligned with the existing recoil starter. Track 12 is shown in broken view, and the length thereof is to be selected in accordance with the desired length of a starting stroke.

Figure 3:
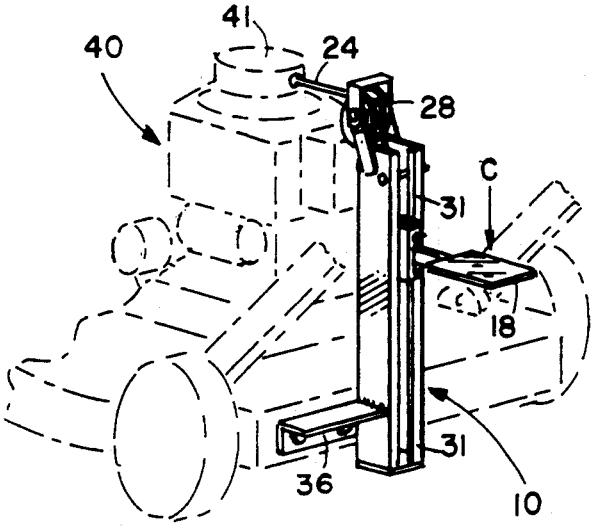
FIG. 3 is a perspective view of the device of FIG. 1 installed on a power lawnmower (shown in phantom view).

FIG. 3 illustrates a typical installation of the step starter 10 of the invention. A device 40, shown in phantom view, has a small mower engine with a conventional recoil starter 41. The exemplary starter 10 is bolted to device 40 at the back end of the mower by means of bracket 36. Pull cord 24 has its handle removed and is attached to trolley unit 14 as described above. The length of cord 24 is selected to hold trolley unit 14 against pin 33 before use. Pedal 18 is rapidly pushed downward by the foot as indicated by arrow C during the starting procedure for device 40. The operator may be grasping the handles of mower 40, adjacent the engine controls during starting, obviating the need to place a foot on the mower deck as required with some prior art mowers.

The invention has been disclosed with reference to a specific embodiment. However, various modifications in design may be made without departing from the spirit and scope of the invention.

We claim:

1. In an internal combustion engine of the type having a recoil starter, said recoil starter having a pull rope, the improvement of a recoil starter comprising:

a vertically oriented track rigidly attached to the engine frame;

a wheeled trolley disposed in said track to move therealong;

a foot pedal attached to, and extending from said trolley; and rope attachment means for attachment of a distal end of the recoil starter pull rope to said trolley wherein stepping on and depressing said pedal downward operates the recoil starter.

2. The step starter as defined in claim 1 in which:

said track is formed from channel stock, and includes inwardly extending rails; and said trolley includes a set of wheels adapted to ride within said channel stock along said rails.

3. The step starter as defined in claim 1 in which said means for attaching said pull rope to said trolley includes;

a pulley mounted at an upper end of said track for guiding said pull rope; and said trolley includes an opening therein for accepting the distal end of said pull rope.

4. The step starter as defined in claim 1 in which said foot pedal includes a non-slip surface on an upper surface thereof.

5. The step starter as defined in claim 1 in which said track includes means for captivating said trolley in said channel stock.

6. The step starter as defined in claim 1 in which said track includes a bracket for attaching said track to said engine.

7. In an internal combustion engine of the type having a recoil starter, said recoil starter having a pull rope, the improvement of the recoil starter in form of a step starter comprising:

a vertically oriented track formed from channel stock, and including inwardly extending rails, said track rigidly attached to the engine;

a trolley having a set of wheels, and an opening therein for accepting a distal end of the pull rope, said trolley adapted to ride within said channel stock along said rails;

a foot pedal attached to, and extending from said trolley;

a pulley mounted at an upper end of said track for guiding the pull rope;

wherein stepping on and depressing said pedal downward operates the recoil starter.

* * * * *